US005621974A

United States Patent [19]

Rose et al.

[11] Patent Number: 5,621,974

[45] Date of Patent: Apr. 22, 1997

[54] CUTTING IMPLEMENT

[75] Inventors: Anthony T. Rose; Theresa M. Rose, both of Westlake Village, Calif.

[73] Assignee: Anthony W. Rose, Jr., Tempe, Ariz.

[21] Appl. No.: 534,483

[22] Filed: Sep. 27, 1995

[51] Int. Cl.[6] ..... B26B 13/04

[52] U.S. Cl. ..... 30/260; 30/349

[58] Field of Search ..... 30/234, 260, 349, 30/350, 357, 346, 122

[56] References Cited

U.S. PATENT DOCUMENTS

| | | | |
|---|---|---|---|
| 2,869,311 | 1/1959 | Beeston | 30/350 X |
| 4,890,388 | 1/1990 | Rose | 30/260 |

*Primary Examiner*—Douglas D. Watts
*Attorney, Agent, or Firm*—Roger A. Marrs

[57] ABSTRACT

A cutting implement such as of the scissors type is disclosed herein, having a pair of elongated shanks pivoted together midway between their opposite ends so that opposing blade cutting edges converge together as the shanks are closed towards one another. The cutting edges are carried on an exposed edge marginal region of either permanent or replaceable blades disposed into open receptacles on the respective shanks. Each shank receptacle is defined by sloping surfaces at the opposite ends of each receptacle and a pair of stepped posts is provided in spaced apart relationship between the opposite opening ends. A replaceable blade is formed with a plurality of recesses along the edge opposite to the cutting edge leading into longitudinal slots whereby the shank posts are indexed or registered with the blade recesses for snap-lock retention therewith into the slots with the blade seated on the post steps. A permanent blade is provided with shaped holes for placement on the steps of the posts. A cover having shaped holes is placed on the step of the posts and between the opposite shaped ends of the recess. The cover is welded at the ends to the shank and to the posts. The replaceable blade may be composed of spring steel while the permanent blade may be of ceramic composition.

3 Claims, 1 Drawing Sheet

CUTTING IMPLEMENT

BACKGROUND OF THE INVENTION

1. Field of the Invention

The present invention relates to the field of scissors, shears, knives and similar cutting implements and more particularly to a novel such cutting implement construction having a permanent or replaceable cutting blade which is separate from the implement shank or handle residing in a recess or cavity between a welded cover and the shank or handle.

2. Brief Description of the Prior Art

In the past, major inconveniences with which a surgeon, barber or other worker had to contend involve the problem of maintaining a sharp, keen cutting edge on the instrument in order to perform the best work. The user has to continually maintain these sharp instruments in order to obtain proper performance. This problem is also presented to a surgeon who, in addition, is faced with the problem of sanitation of his surgical instrument. Therefore, attempts have been made to utilize cutting blades adapted to be mounted on the shanks of scissors or the like for easy and quick removal without damage to the latter or for long lasting or permanent installation. However, problems have been encountered which stem largely from the fact that insertion of such blades, whether of metal or ceramic construction, into the respective shanks of a scissors or handle of a knife is not guided and relies solely on feel and visual observation. Also, removal of blades, when dull or damaged, is difficult and generally requires the two hands of the user to successfully eject or remove blades.

In other instances, problems have been encountered with premature release or lack of retention for the blades on the shank so that blades sometimes dislodged and fell from the shank when in use.

Manufacturing of cutting blades of metal or ceramic materials is difficult and particularly the fabrication of the implement to accept the mounting or joining of the blade with the scissor shank or the knife handle. When such prior instruments are used in specialized situations, such as when surgical instruments are employed, extremely hard and dense materials are used for producing the scissors or implement. Such compositions are difficult, and therefore expensive to drill, form or otherwise provide the necessary recesses, openings, apertures or the like in order to fabricate a high performance instrument. The cost involves not only highly skilled labor, but the cost of cutting implements which are required to form the surgical steel used in the fabrication of such instruments.

Therefore, a long standing need has existed to provide a cutting implement for accepting replaceable or permanent blades, but which is self-indexing or registering so that the blade of either type may be automatically installed at its location on the implement. Additionally, it is preferred to have a positive retention means for holding the blade in position on a shank or handle so that it will not be inadvertently dislodged.

SUMMARY OF THE INVENTION

Accordingly, the above problems and difficulties are obviated by the present invention which provides a novel cutting implement having an elongated shank or holder provided with a shaped recess and stepped posts for receiving either a replaceable or a permanent blade. The recess is provided with contoured surfaces defining the respective ends of the opening or recess so that insertion and/or ejection of the blade is self-locating and self-ejecting when a replaceable blade is urged into or out of the recess or opening. Guide means are respectively and cooperatively carried on the replaceable or permanent blade as well as the implement within the opening for positive retention when either blade has been properly located within the opening. A cover plate with index holes is installed on the upper step or level of the posts to define one side of the recess occupied by the blade. The blade sets on a lower step of the posts between the cover plate and the shank. The cover plate is secured to the shank by welding at the engagement points of the cover plate with the posts and at the opposite ends of the cover plate with the shank. A permanent blade is held in place by the cover plate while the retention of the replaceable blade is yieldable for release by forcible engagement with an end shoulder on the blade exposed for the purpose of engagement by a removal tool or means. The shaped and stepped angular end surfaces and the upper and lower steps or levels of the posts for guidance and alignment of the blade within the recess of the shank of the implement are placed at aligned angles with respect to one another so as to permit relatively convenient and inexpensive formation utilizing surgical steel at the composition for the implement.

Therefore, it is among the primary objects of the present invention to provide a cutting device utilizing cutting blades of either a permanent or replaceable type which are adapted to be mounted in such a secure way for easy and quick assembly without damage to the implement or the user.

Another object of the present invention is to provide a novel cutting device incorporating a separate cutting blade in the form of an insert adapted to be guided into and out of a receiving opening on the implement during assembly and which is relatively economical to manufacture and to use.

Another object of the present invention is to provide a novel cutting implement having cutting blades which are sufficiently inexpensive to permit disposal thereof when dull or damaged once they have lost their cutting edge or have become contaminated.

Still a further object of the present invention is to provide a novel cutting implement, having replaceable or permanent blades, which includes self-indexing or registering means for automatically locating a blade on the instrument and which further includes a positive retention means for yieldably or permanently holding the blade in the location. The blade may be of metal or ceramic fabrication.

A further object of the present invention is to provide a novel cutting device, utilizing blades which incorporates a positive retention means on a shank for holding the blade in position, and which further includes centering or guidance means for locating a respective cutting blade on the shank or handle so that it is in position to perform its intended purpose.

An object resides in providing a blade holder with stepped level posts and stepped level guide means for first accepting a blade in position on the holder and secondly, for accepting a cover plate followed by welding the cover plate to the holder. Blades of metal may be of a replaceable or removable type or of ceramic when permanently installed.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description taken in connection with the accompanying drawings in which:

DESCRIPTION OF THE PREFERRED EMBODIMENT

Figure 1:
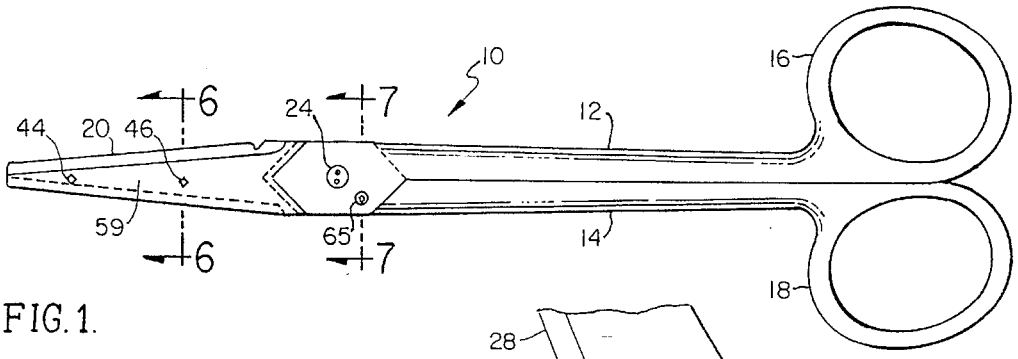
FIG. 1 is a side elevational view of a cutting device in the form of a scissors incorporating the novel mounting and retaining means for a cutting blade in accordance with the present invention.
Figure 2:
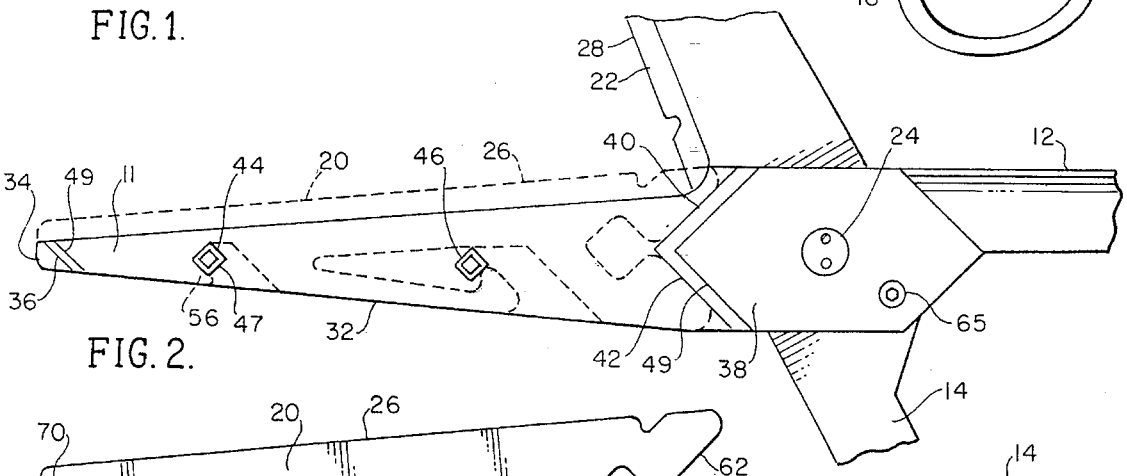
FIG. 2 is an enlarged fragmentary sectional view of a shank of the scissors shown in FIG. 1, illustrating a replaceable blade in dotted lines inserted into a holding or retaining cavity or opening provided in the shank.

Referring to FIGS. 1 and 2, the novel cutting implement or device of the present invention is illustrated in the general direction of arrow 10 which takes the form, in one version, of a scissors, a knife having a blade extending from a handle would be another version. The scissors is formed with a first shank 12 and a second shank 14. The rear ends of the shanks 12 and 14 are formed into openings 16 and 18 respectively, to facilitate cooperation with the fingers of a person using the implement. A forward end or extension 11 of each of the shanks 12 and 14 is formed into blades 20 and 22 respectively. Blades 20 and 22 are to be movable together in an abutting relationship by means of movement of the shanks 12 and 14 about a pivot connection 24.

Figure 6:
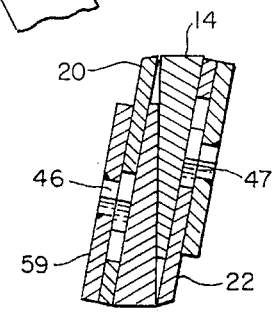
FIG. 6 is a transverse cross-sectional view of the shanks of the cutting device shown in FIG. 1 as taken in the direction of arrows 6—6 thereof.

Referring now in detail to FIGS. 2 and 6, it can be seen that the respective blades 20 and 22 include cutting edges 26 and 28 which engage with each other along a shear line defined by the opposing and abutting surfaces of the forward ends 11 of shanks 12 and 14 respectively.

Referring further to FIG. 2, it can be seen that the forward end 11 of shank 12 is formed with an elongated opening indicated in general by numeral 32, which is defined at its opposite ends by a nose portion 34, having an angular or sloping surface 36, and a tail portion 38 having converging, sloping surfaces 40 and 42 respectively. Midway between the angular surfaces 36 and 42, guide cross elements or posts 44 and 46 are provided, which project outwardly from the forward end 11 of the shank 12. Therefore, it can be seen that each forward end of a shank includes an elongated opening defined by sloping surfaces at the opposite ends of the opening, which are defined by portions 34 and 38 respectively.

Figure 3:
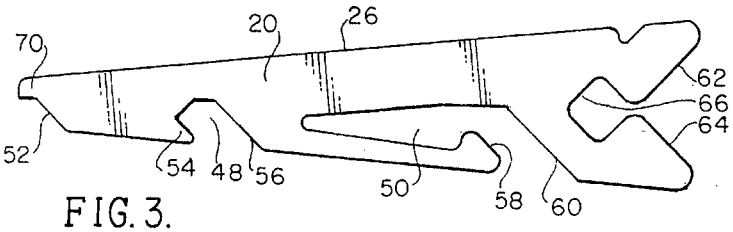
FIG. 3 is a side elevational view of a metal replaceable blade.

It is also to be noted that the square or diamond shape of posts 44 and 46 includes external surfaces on the base and terminus or tip which run in parallel with respect to the surface 36 and the surfaces 40 and 42 respectively. These surfaces form guide means for directing a replaceable cutting blade while being inserted into the opening. Such a blade is shown in FIG. 3. Guide means are included which cooperate with conformal surfaces provided on the replaceable cutting blade 20 in order to effect correct insertion of the blade into the opening and, ultimately, to provide positive retention.

With respect to the blade 20, it can be seen in FIG. 3 that the stainless steel blade includes a cutting edge 26 along one side while the opposite side is provided with a pair of recesses leading into slots 48 and 50 respectively. During insertion, the cross posts 44 and 46 are aligned with the recesses as the blade is slipped through into the opening, the blade is forced rearwardly by the engagement of slope 36 with a forward inclined surface 52 on the blade and engagement of the external surfaces of the cross posts 44 and 46 with surfaces 54 and 56 of the first recess leading into slot 48, and by means of opposing, sloping surfaces 58 and 60, defining the other recess associated with slot 50 and the external surfaces of the cross post 46.

The rearmost terminating end of the replaceable blade 20 includes a dovetail pair of surfaces 62 and 64 which mate with surfaces 40 and 42 to provide positive alignment and registry for locating the blade. The surfaces 62 and 64 terminate in a converging fashion with an opening 66 so that the tail of the blade may be slightly expanded or raised to be in firm engagement with the dovetail portion 38 of the shank.

It can be seen that the blade 20 has been indexed, registered and located within the opening 32 by means of the slopes, angles surfaces cooperating with conformal slopes and angular surfaces on the blade. The blade 20 is nested within the opening of the forward end of shank 12 so that a tip of the blade 70 rests against the nose portion 34 while the conformal surfaces 36 and 52 are in abuttment. The dovetail surfaces 40 and 42 are in alignment with the surfaces 62 and 64 so that the ends of the blade are biased outwardly. Thus, the forward and rear ends of the blade are prevented from being inadvertently removed.

Each post 44 and 46 includes a diamond-shaped base 47 serving as a guide from the surface of the forward end 11 and a projecting terminus of reduced dimension rising above the level or step 47. Portions 34 and 48 are stepped in a similar manner having a level or step indentified by numeral 49. The height of the steps 47 and 49 are equal and serve as platforms, in unison, to support a blade thereon. Therefore, the end slopes or angles along with the posts serve as guides and retainers for installing the blade while the steps 47 and 49 support the blade on the forward end 11.

Therefore, it can be seen that the holes of either blade 20 or 62 may be placed over posts 44 and 46 and will engage the surface of the forward end 11 with the enlarged shaped bases of each post occupying a respective hole. The terminus or tip of each post will occupy the holes 60 and 61 in the cover plate 59. The cover plate rests at its opposite ends on the step 49. Welds to the nose and tail portions as well as to the posts will secure the cover to the shank forward end 11.

Figure 4:
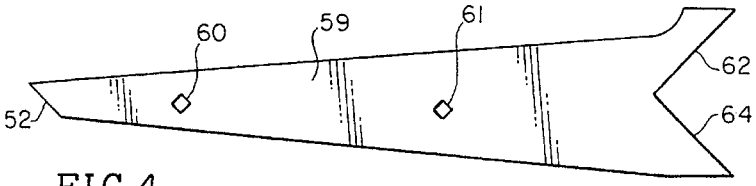
FIG. 4 is a cover plate.

Each post includes a shaped base which insertably receives or snap-in locks with the blade so that one side of the blade engages with and rests against the adjacent surface of the forward end 11. However, the nose portion 34, tail portion 38 and cross posts 44 and 46 include a step indicated by numeral 49 and 47 respectively. These steps, levels or surfaces support a cover 59 as shown in FIG. 4 which fits onto the tips of posts 44 and 46 via shaped holes 60 and 61 with the front end bearing against the nose portion 34 and the back portion bearing against the tail portion 38. The installation of the cover is shown in FIG. 6 whereby the cover is laser welded to the nose and tail portions respectively as well.

Figure 5:
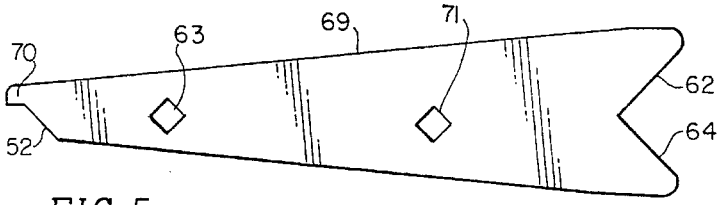
FIG. 5 is a side elevational view of a ceramic blade for permanent mounting.

The blade 20 is composed of a resilient stainless steel metal and is an example of a replaceable blade. However, the same blade mounting as described above may be employed for a ceramic or carbide blade in a permanent installation. Such a blade is composed of a brittle material shown in FIG. 5 by numeral 62 having enlarged holes 63 and 64 which fits over the enlarged bases of posts 44 and 46 respectively.

The replaceable blade 20 may be inserted or removed from its mounting between the cover plate and the opposing surface of the forward end as described in U.S. Pat. No. 5,157,837.

Figure 7:
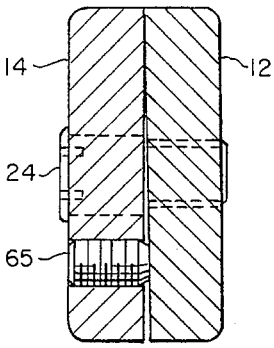
FIG. 7 is a transverse cross-sectional view of the cutting device as taken in the direction of arrows 7—7 of FIG. 1.

The inventive concept further includes a tension means for adjusting the tension between the shanks 12 and 14. The shanks may become loose after extensive use and a screw 65 shown in FIGS. 2 and 7 may be employed. When tightened, the screw will bear against the opposing shank 12 to increase resistence to manually open and close the shanks during a cutting procedure. Each shank may employ an adjustable screw. If two screws are used, they must be off-set from each other to avoid interference.

It is to be understood that the blades and mounting thereof can be used not only on scissors, but on single blade knives or, if desired, in a scissors a replaceable blade may be installed on one shank forward end while a permanent blade may be installed on the other shank forward end. The cutting implement may employ permanent and/or detachable hard blades. To make the implement or scissors perform a precision cut, the scissor bodies are separate from the cutting edges utilizing new, sophisticated materials, interchangeable stainless steel and ceramic material that has the highest variable statistics. All types of scissors bodies are formed at the present time using metal injection molding systems (also castings). Stainless steel scissor bodies are crush ground for cavity (or nest) to achieve a high precision repeatability for the permanent (ceramic or carbide) or the detachable stainless steel cutting inserts. The present technology incorporating the inventive concept is to insert the cutting blades into the scissor bodies (ground cavity or nest) and using the stainless steel plate that will cover the blade securing the cutting blade into position. The cover plate is laser welded at several locations to the scissor body and makes it possible to remove the detachable blade from the slot and leave open the cavity for the next blade or the permanently closed ceramic blades or carbide material blades.

Ceramic and carbide are brittle materials with low ductility (flexibility) and this property does not allow for a built-in spring locking system. Therefore, part of the scissor body is used as stationary with the permanently built blade either smooth or serrated. The other side of the scissor body has an open slot for detachable blade inserts but can be assembled either way with solid insert or both detachable inserts. Assembled either way, with a permanent insert or a detachable self-positioning spring action blade, the stamping technologies are the fastest, most practical and economical method of producing blades because the cutting edge is an integral part of the system. For portable surgery or first aid situations it is practical to use the existing blades and inject non-conductive, high impact material for the scissor body with a permanent blade insert used only one time. After assembly, the scissor alignment is very important. To physically bend the scissor blade section is not possible because the insert is rigid and brittle and can be broken. To prevent or solve this problem, a micro adjustment set screw is placed behind the end of the axis of the scissor blade. The adjusted pressure moves the scissor shaft left and right that influence the scissors cutting blades tight or loose from the axis screws towards the scissor blade tips. Using these techniques along with hard coating on the surface to prevent wear and galling, it will keep scissor bodies away from requiring service or changing blade inserts for a long time.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A cutting implement comprising:

an elongated shank having a forward end defining an open cavity;

said cavity defined by a reduced thickness of said forward end and terminating at the opposite ends of said cavity with angular shoulders;

at least one pair of posts carried on said forward end projecting through said cavity and disposed in fixed spaced-apart relationship with respect to said angular shoulders;

a cover plate closing a side of said cavity opposite to said forward end so that said cavity is open at top and bottom of said forward end;

a cutting blade mounted on said pair of posts within said cavity and having a cutting edge exposed beyond said cavity;

laser- welds securing said cover plate to said angular shoulders;

said angular shoulders and said posts are stepped so as to include several enlarged bases supporting said blade on said forward end and for supporting said cover plate;

said blade is a permanent blade composed of a ceramic and carbide composition; and said forward end includes a raised nose portion defining one end of said cavity and a tail portion spaced from said nose portion defining the other end of said cavity; and said nose portion and said tail portion provided with flat surfaces on each of said angular shoulders for supporting said cover plate.

2. The invention as defined in claim 1 wherein:

said pair of posts include tips of reduced proportions from said enlarged bases; and said cover plate having a pair of holes for insertably receiving said post tips of reduced proportions.

3. A cutting implement comprising:

at least one elongated shank having a shaped recess provided in a selected side of said shank and said recess being defined between contoured raised portions defining the respective ends of said shaped recess;

a blade having a cutting edge and shaped forward and tail ends conformal to said contoured raised portions whereby retention of said blade is produced when said blade is inserted into said shank recess;

guide means cooperatively carried on said shank and said blade for positioning said blade into said shank recess to effect conformal mating of said shaped forward and tail ends of said blade with said contoured raised portions;

said guide means comprises a pair of posts laterally projecting outwardly from said shank recess in fixed spaced-apart relationship with respect to each other and with respect to said end countoured surfaces;

a cover plate having opposite ends supported on said contoured raised portions and having openings engaged with said posts so as to close the side of said cavity opposite end to said forward end; and weld means securing said cover plate to said contoured raised portions and to said posts.

* * * * *